US007810443B2

(12) United States Patent
Preiss

(10) Patent No.: US 7,810,443 B2
(45) Date of Patent: Oct. 12, 2010

(54) MOTORBOAT HAVING A CABIN WINDSCREEN

(75) Inventor: Michael Preiss, Vaihingen (DE)

(73) Assignee: Dr. Ing. h.c. F. Porsche AG, Stuttgart (DE)

( * ) Notice: Subject to any disclaimer, the term of this patent is extended or adjusted under 35 U.S.C. 154(b) by 10 days.

(21) Appl. No.: 12/105,368

(22) Filed: Apr. 18, 2008

(65) Prior Publication Data

US 2008/0264324 A1 Oct. 30, 2008

(30) Foreign Application Priority Data

Apr. 28, 2007 (DE) ..... 10 2007 020 193

(51) Int. Cl.
*B63B 38/00* (2006.01)

(52) U.S. Cl. ..... 114/343; 114/361

(58) Field of Classification Search ..... 114/343, 114/361; 440/89 R

See application file for complete search history.

(56) References Cited

U.S. PATENT DOCUMENTS

| | | | | |
|---|---|---|---|---|
| 2,947,277 | A * | 8/1960 | Stevens | 114/71 |
| 3,165,762 | A * | 1/1965 | Hage | 114/361 |
| 3,195,549 | A * | 7/1965 | Stevens | 114/361 |
| 4,714,443 | A | 12/1987 | Chaplin et al. | |
| 5,052,326 | A | 10/1991 | Wiggen et al. | |
| 5,088,438 | A | 2/1992 | Richardson, Jr. et al. | |
| 5,628,265 | A | 5/1997 | Azima et al. | |
| 5,791,952 | A * | 8/1998 | Trinkl | 440/89 R |

FOREIGN PATENT DOCUMENTS

| | | |
|---|---|---|
| EP | 0710603 A1 | 5/1996 |
| FR | 2892377 A1 | 4/2007 |
| WO | 9304912 A1 | 3/1993 |

OTHER PUBLICATIONS

European Search Report dated Sep. 2, 2008.

* cited by examiner

*Primary Examiner*—Edwin Swinehart

(57) ABSTRACT

A motorboat, in particular a yacht, with a cabin which merges on a rear side into a cockpit which is delimited laterally by side sections. To improve the wind comfort in the cockpit, a respective side guiding element for guiding the flow is disposed on each side of the boat. The side guiding element extends generally vertically upward and generally in the longitudinal direction of the boat from a rear end section of the respective side section.

11 Claims, 2 Drawing Sheets

MOTORBOAT HAVING A CABIN WINDSCREEN

CROSS-REFERENCE TO RELATED APPLICATION

This application claims the priority, under 35 U.S.C. §119, of German application DE 10 2007 020 193.3, filed Apr. 28, 2007; the prior application is herewith incorporated by reference in its entirety.

BACKGROUND OF THE INVENTION

Field of the Invention

The present invention relates to a motorboat, in particular a yacht.

Larger motorboats, in particular yachts, have a cabin which merges on the rear side into a cockpit. As is known, the cabin is a space on board the particular ship or boat that can be used as a living room, day room or bedroom. A cockpit is a part on a boat deck at which there is a control stand with seats. The cockpit is delimited laterally by side sections. If a cockpit is open, when an air flow approaches in the longitudinal direction of the boat, wind can enter the cockpit in the form of a rear backflow, which may be annoying to people who are in the cockpit. In this case, there may already be annoying wind from the relative wind when the motorboat is operated at increased speed.

SUMMARY OF THE INVENTION

It is accordingly an object of the invention to provide a motorboat that overcomes the above-mentioned disadvantages of the prior art devices of this general type, which is distinguished by improved comfort with regard to wind annoyance in the region of the cockpit.

With the foregoing and other objects in view there is provided, in accordance with the invention, a motorboat. The motorboat contains side sections each having a rear end section, a cockpit delimited laterally by the side sections, a cabin having a rear side merging into the cockpit, and side guiding elements for guiding a flow. A respective one of the side guiding elements is disposed on each side of the motorboat, each of the side guiding elements extends generally vertically upward and generally in a longitudinal direction of the motorboat from the rear end section of one of the side sections.

The invention is based on the general concept of disposing side guiding elements for guiding the flow, which elements protrude upward in the region of rear end sections of side sections which laterally delimit the cockpit. It has been shown that, with the aid of such side guiding elements, the backflow in the region of the cockpit can be considerably reduced, which correspondingly improves the comfort for people in the cockpit. In this case, it is notable that the cockpit remains open even when the side guiding elements are fitted. This is achieved in particular by the fact that the side guiding elements are disposed spaced apart from a rear end of the cabin.

In principle, the side guiding elements may be configured such that they are free-standing. In a preferred embodiment, the cabin can have lateral roof frame elements which extend in the longitudinal direction of the boat as far as a rear end of the cockpit at a distance from the side sections. The respective side guiding elements are then preferably configured in such a manner that they extend in each case upward from the rear end section of the respective side section as far as a rear end section of the respective roof frame element. By this measure, better stability can be achieved for the side guiding elements.

In the case of another advantageous embodiment, a roof guiding element for guiding the flow can also be provided, the roof guiding element extending generally horizontally and from the rear end section of the one roof frame element to the rear end section of the other roof frame element. With the aid of such a roof guiding element, protection against backflows in the cockpit can be additionally improved. Even when such a roof guiding element is fitted, the cockpit can remain open. The roof guiding element can preferably be fitted at a distance from a rear end of the cabin.

In accordance with an added feature of the invention, the roof guiding element is configured flat, is disposed such that it is generally horizontal and has an approach edge extending transversely with respect to the longitudinal direction of the motorboat and a discharge edge extending transversely with respect to the longitudinal direction of the motorboat.

In accordance with an additional feature of the invention, the side guiding elements are configured flat, are disposed generally vertically and have an approach edge extending transversely with respect to the longitudinal direction of the motorboat and a discharge edge extending transversely with respect to the longitudinal direction of the motorboat.

In accordance with another feature of the invention, the side guiding elements and/or the roof guiding element is a sail stiffened and stretched by of bows.

In accordance with a further feature of the invention, the side guiding elements and/or the roof guiding element is positioned at an angle in relation to the longitudinal direction of the motorboat.

In accordance with another added feature of the invention, the side guiding elements and/or the roof guiding element is configured such that it is curved in relation to the longitudinal direction of the motorboat.

In accordance with another further feature of the invention, an angle at which the side guiding elements and/or the roof guiding element is positioned in relation to the longitudinal direction of the motor boat can be adjusted.

In accordance with another additional feature of the invention, the side guiding elements and/or the roof guiding element is a fixed component made of sheet metal, plastic, or Plexiglas.

In accordance with a concomitant feature of the invention, at least one exhaust gas outlet opening is disposed outside the motorboat in a region of the cockpit. An exhaust gas guiding element is provided for guiding an exhaust gas flow. The exhaust gas outlet opening is assigned to the exhaust gas guiding element which emerges from the exhaust gas outlet opening, parallel to the longitudinal direction of the motor boat in a direction of a rear of the motorboat.

Other features which are considered as characteristic for the invention are set forth in the appended claims.

Although the invention is illustrated and described herein as embodied in a motorboat, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
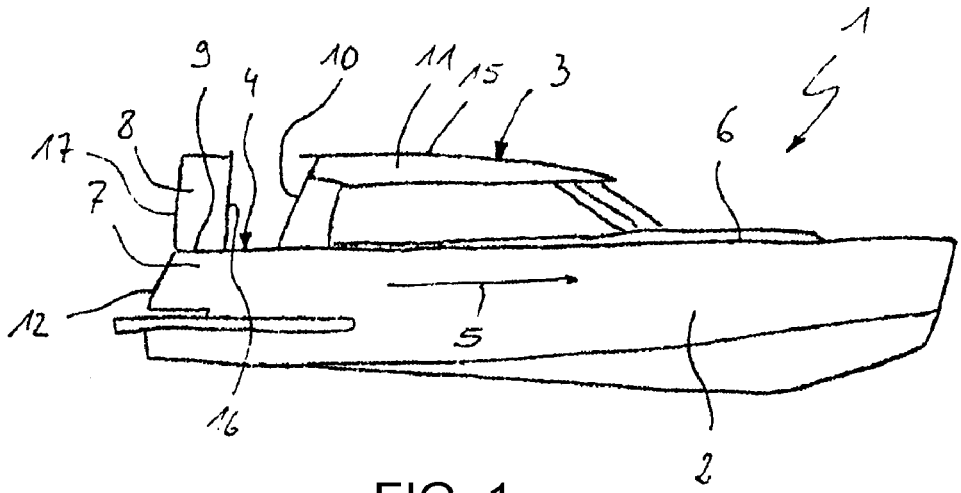
FIG. 1 is a diagrammatic, side view of a motorboat according to a first embodiment of the invention.

Referring now to the figures of the drawing in detail and first, particularly, to FIG. 1 thereof, there is shown a motorboat 1, which is preferably a motor yacht, and contains a hull 2 with a cabin 3 and a cockpit 4. The cockpit 4 is located in the rear of the motorboat 1 and on the rear side, i.e. with respect to a longitudinal direction 5 of the boat, rearwardly adjoins the cabin 3. The cockpit 4 is disposed at a lower or deeper level than a deck 6 of the motorboat 1. The cockpit 4 is delimited laterally by side sections 7. For the purpose of providing a simplified illustration, a control stand and seats which are usually situated in the cockpit 4 are not illustrated here. From the cockpit 4, there is usually a passageway or companionway into the cabin 3. The cockpit 4 is configured here as a cockpit 4 which is open laterally and at the top. The cockpit 4 therefore in particular does not have fixed side walls nor a fixed roof.

In the case of wind from the front or when the motorboat 1 is traveling straight ahead relatively rapidly, a flow of air around the motorboat 1 is produced, the flow of air causing a pressure reduction in the rear region, i.e. in the region of the cockpit 4, which leads to annoying backflows. The wind effects arising in this manner may annoy people in the cockpit 4. In order to avoid these negative wind effects, the motorboat 1 is equipped on each side of the boat, i.e. on the starboard and port sides, with a respective side guiding element 8 which serves to guide the flow and extends in each case generally vertically upward and generally in the longitudinal direction 5 of the boat from a rear end section 9 of the respective side section 7. It is notable in this case that the respective side guiding element 8 is disposed at a distance from a rear end 10 of the cabin 3. In this respect, the cabin 4 remains laterally open. By fitting the side guiding elements 8, a lateral penetration of a backflow into the cockpit 4 can be effectively prevented, which considerably improves the wind comfort in the cockpit 4.

In the case of the embodiment shown in FIG. 1, the side guiding elements 8 are configured to be free-standing, and therefore they are merely fastened to the respective side section 7. The height of the side guiding elements 8 preferably corresponds generally to the height of the cabin 3.

Figure 2:
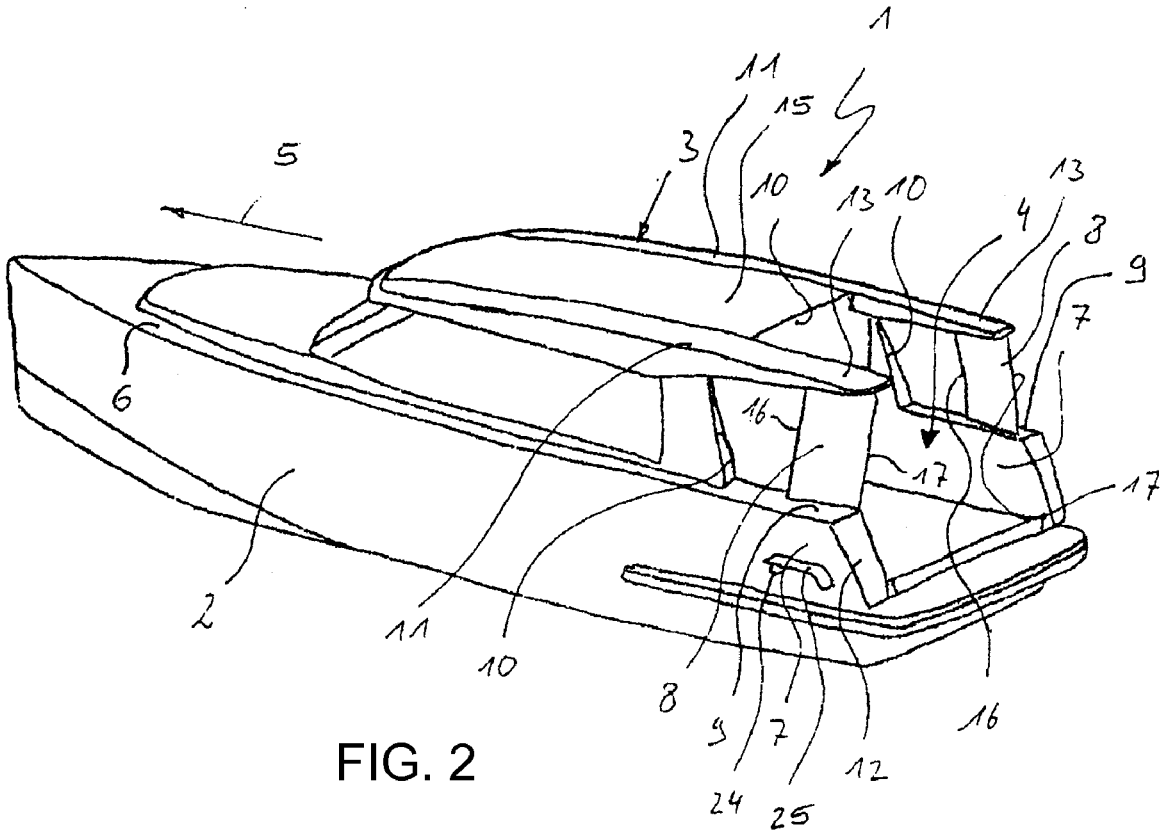
FIG. 2 is a diagrammatic, perspective view of the motorboat according to a second embodiment.
Figure 3:
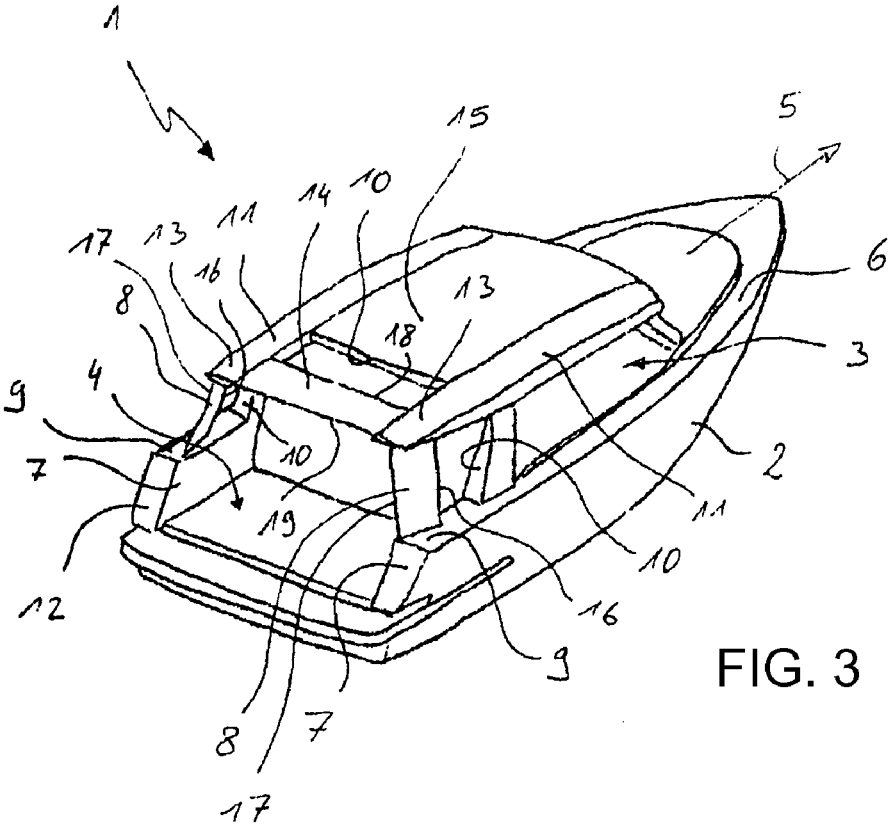
FIG. 3 is a diagrammatic, perspective view of the motorboat according to a third embodiment.

According to FIGS. 1 to 3, the cabin 3 has lateral roof frame elements 11 which extend in the longitudinal direction 5 of the boat. In the embodiment according to FIG. 1, the roof frame elements 11 end at the rear end 10 of the cabin 3, i.e. at the transition to the cockpit 4. In contrast thereto, in the embodiments of FIGS. 2 and 3, the roof frame elements 11 extend on the rear side beyond the cabin 3, to be precise as far as a rear end of the cockpit 4. The roof frame elements 11 here extend in the vertical direction at a distance from the side sections 7.

In the embodiments of FIGS. 2 and 3, the side guiding elements 8 are disposed in such a manner that they extend in each case upward from the rear end section 9 of the respective side section 7 as far as a rear end section 13 of the respective roof frame element 11. In particular, the side guiding elements 8 can thereby be fixed at the bottom to the side sections 7 and at the top to the roof frame elements 13, which considerably improves the stability of the side guiding elements 8.

FIG. 3 shows a further embodiment, in which a roof guiding element 14 is provided in addition to the side guiding elements 8. The roof guiding element 14 also serves to guide the flow. In contrast to the side guiding elements 8, it extends generally horizontally and is disposed here between the rear end sections 13 of two roof frame elements 11 and is fixed thereto. The roof guiding element 14 is preferably disposed at a distance from the rear end of the cabin 3 in the longitudinal direction 5 of the boat. Accordingly, even when the roof guiding element 14 is fitted, the cockpit 4 remains open at the top. During operation of the motorboat 1, air may flow above a roof 15 of the cabin 3, which roof is bordered laterally by the roof frame elements 11. The flow can break away at the rear end 10 of the cabin 3 and, due to negative pressure at the rear, can flow back virtually from above into the cockpit 4. This backflow is considerably reduced by the fitting of the roof guiding element 14, which increases the wind comfort in the cockpit 4.

The side guiding elements 8 and the roof guiding element 14 are preferably configured to be flat. In this case, "flat" means that the thickness of the respective guiding element 8, 14 is significantly smaller than the length and the width of the respective guiding element 8, 14. The side guiding elements 8 are disposed generally vertically and therefore have a vertical approach edge 16 and a vertical discharge edge 17 spaced apart therefrom in the longitudinal direction 5 of the boat. The approach edge 16 and the discharge edge 17 each extend transversely here with respect to the longitudinal direction 5 of the boat. The same also applies to the roof guiding element 14 which is disposed generally horizontally and, accordingly, has a horizontal approach edge 18 extending transversely with respect to the longitudinal direction 5 of the boat and, spaced apart therefrom in the longitudinal direction 5 of the boat, a horizontal discharge edge 19 extending transversely with respect to the longitudinal direction 5 of the boat.

The guiding elements 8, 14 can be provided on the motorboat 1 in such a manner that they can be fitted relatively simply if the need arises and can easily be removed if the wind drops or the motorboat 1 is stationary.

The guiding elements 8, 14 can preferably have a curvature with respect to the longitudinal direction 5 of the boat. For example, the guiding elements 8, 14 are each curved outward with respect to the cockpit 4. The guiding elements 8, 14 are therefore curved convexly outward and, in particular, curved concavely inward. By this curvature, the guiding elements 8, 14 can be configured in the manner of a wing or in the manner of a spoiler.

The side guiding elements 8 can be positioned at an angle in relation to the longitudinal direction 5 of the boat. This means that a plane in which the approach edge 16 and the discharge edge 17 of the respective side guiding elements 8 lie is positioned at an angle in relation to the longitudinal direction 5 of the boat. By the positioning of the side guiding elements 8 at an angle, a flow which flows laterally around the cabin 3 and breaks away at the rear end 10 of the cabin 3 can be extended rearward with the aid of the respective side guiding element 8 and can be prevented from penetrating the cockpit 4. In this case, the side guiding elements 8 are positioned at an angle in such a manner that the respective approach edge 16 is further away from a longitudinal center plane of the motorboat 1 than the associated discharge edge 17.

The roof guiding element 14 is expediently also positioned at an angle in relation to the longitudinal direction 5 of the boat. The roof guiding element 14 preferably drops downward from the approach edge 18 to the discharge edge 19. By the positioning of the roof guiding element 14 at an angle, the flow which brushes over the roof 15 and breaks away at the rear end 10 of the cabin 3 is extended rearward and prevented from penetrating the cockpit 4.

Furthermore, the positioning of the guiding elements 8, 14 at an angle causes a reduction in the drop in pressure in the rear region of the motorboat 1, which reduces the tendency for backflows into the cockpit 4.

Embodiments in which the angle at which the respective guiding element 8, 14 is positioned can be adjusted are particularly advantageous. For example, for this purpose the respective guiding element 8, 14 can be held pivotably in the region of its approach edge 16 or 18. At the same time, latching devices or special securing ropes, what are referred to as "sheets", can be provided in order to fix the respective guiding element 8, 14 at the respectively adjusted positioning angle.

In the longitudinal direction 5 of the boat, the respective guiding element 8, 14 has a length which preferably lies within a range of between one third and half of the length of the cockpit 4, which is likewise measured in the longitudinal direction 5 of the boat. In particular, the guiding elements 8, 14 here are positioned in such a manner that they end generally flush in the region of the rear end 12 of the cockpit 4. In particular, a discharge edge 17 or 19 of the respective guiding element 8, 14 is located in the region of the rear end 12 of the cockpit 4.

Figure 4:
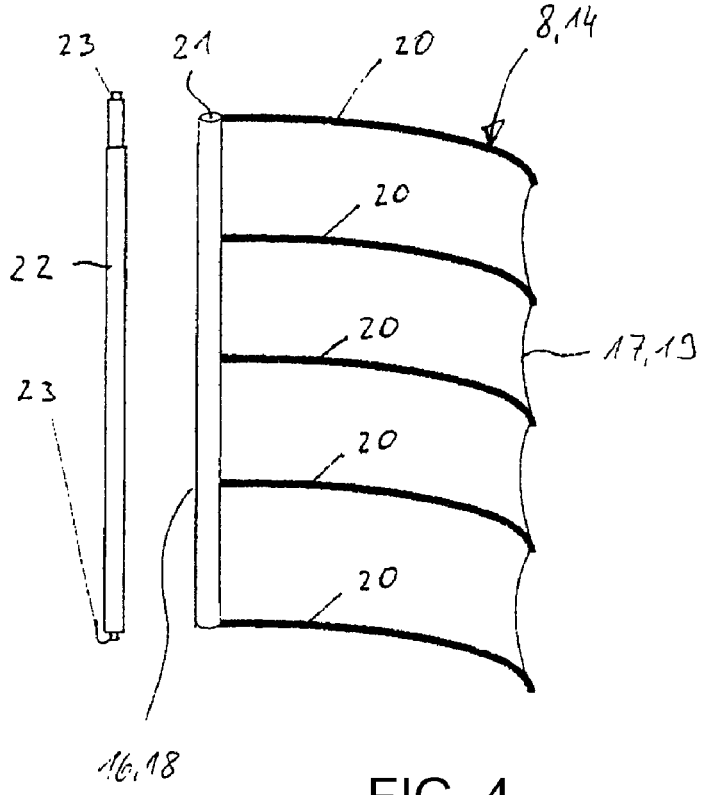
FIG. 4 is a diagrammatic, perspective view of a guiding element.

According to FIG. 4, the respective guiding element 8, 14 can be configured, for example, as a sail and can be composed of a corresponding, flexible material, such as, for example, sail cloth or film. If a film is used, use can be made, in particular, of a transparent film, such as, for example, Mylar film, thus making it possible to ensure a free range of vision. The sail-like guiding element 8, 14 is expediently stiffened and stretched with sail laths or bows 20 in order to obtain the desired shaping for the respective guiding element 8, 14. In the region of the approach edge 16, 18 of the respective guiding element 8, 14, an eyelet 21 can be formed in the sail material and can be used for the respective guiding element 8, 14 to be pulled onto a rod 22. The rod 22 can be telescopic counter to spring force and, at its longitudinal ends, can have pins 23 which, for the fitting of the respective guiding element 8, 14, can be inserted into corresponding pin sockets in the rear end sections 13 of the roof frame elements 11 or in the rear end sections 9 of the side sections 7. By use of the rod 22 being telescopic counter to spring force, the respective guiding element 8, 14 can be fitted and removed particularly easily as a function of requirements. Of course, the guiding elements 8, 14 can also be formed in a fixed manner and can be produced from sheet metal, plastic or Plexiglas.

According to FIG. 2, at least one exhaust gas outlet opening 24 can be positioned in the region of the cockpit 4 on the outside of the hull 2, i.e. outside the boat, through which opening exhaust gases at least from an internal combustion engine, which the motorboat 1 has as the drive, can escape into the surroundings. The exhaust gas outlet opening 24 shown is preferably assigned an exhaust gas guiding element 25. The latter is configured in such a manner that it guides an exhaust gas flow, which emerges from the exhaust gas outlet opening 24, parallel to the longitudinal direction of the boat in the direction of the rear and preferably downward. Such an exhaust gas guiding element 25 can be formed, for example, by a flow baffle or the like. With the aid of the exhaust gas guiding element 25, penetration of exhaust gas into the cockpit 4 is avoided.

The invention claimed is:

1. A motorboat, comprising:

side sections each having a rear end section;

a cockpit delimited laterally by said side sections said cockpit having an open side area above said side sections and an open top;

a cabin having a rear end and a rear side merging into said cockpit; and side guiding elements for guiding a flow, a respective one of said side guiding elements disposed on each side of the motorboat, each of said side guiding elements extending generally vertically upward and generally in a longitudinal direction of the motorboat from said rear end section of one of said side sections and disposed at a distance from said rear end of said cabin, said side guiding elements are configured flat, are disposed generally vertically and have an approach edge extending transversely with respect to the longitudinal direction of the motorboat and a discharge edge extending transversely with respect to the longitudinal direction of the motorboat said open side area of said cockpit located between said cabin and said side guiding elements.

2. The motorboat according to claim 1, wherein:

said cockpit has a rear end;

said cabin has lateral roof frame elements each with a rear end section and extending parallel to the longitudinal direction of the motorboat as far as said rear end of said cockpit at a distance from said side sections; and each of said side guiding elements extends as far as said rear end section of a respective one of said roof frame elements.

3. The motorboat according to claim 2, wherein said roof frame elements include a first roof frame element and a second roof frame element each having a rear end section; and further comprising a roof guiding element for guiding the flow, said roof guiding element extending generally horizontally and from said rear end section of said first roof frame element to said rear end section of said second roof frame element.

4. The motorboat according to claim 3, wherein said roof guiding element is configured flat, is disposed such that it is generally horizontal and has an approach edge extending transversely with respect to the longitudinal direction of the motorboat and a discharge edge extending transversely with respect to the longitudinal direction of the motorboat.

5. The motorboat according to claim 3, wherein at least one of said side guiding elements and said roof guiding element is a sail stiffened and stretched by bows.

6. The motorboat according to claim 3 wherein at least one of said side guiding elements and said roof guiding element is positioned at an angle in relation to the longitudinal direction of the motorboat.

7. The motorboat according to claim 3, wherein at least one of said side guiding elements and said roof guiding element is configured such that it is curved in relation to the longitudinal direction of the motorboat.

8. The motorboat according to claim 3, wherein an angle at which at least one of said side guiding elements and said roof guiding element is positioned in relation to the longitudinal direction of the motor boat can be adjusted.

9. The motorboat according to claim 3, wherein at least one of said side guiding elements and said roof guiding element is a fixed component made of a material selected from the group consisting of sheet metal, plastic, and acrylic glass.

10. The motorboat according to claim 1, further comprising:

at least one exhaust gas outlet opening disposed outside the motorboat in a region of said cockpit; and an exhaust gas guiding element for guiding an exhaust gas flow, said exhaust gas outlet opening is assigned to said exhaust gas guiding element which emerges from said exhaust gas outlet opening, parallel to the longitudinal direction of the motor boat in a direction of a rear of the motorboat.

11. The motorboat according to claim 1, wherein the motorboat is a yacht.

* * * * *